US010960257B2

(12) United States Patent
Potvin

(10) Patent No.: US 10,960,257 B2
(45) Date of Patent: Mar. 30, 2021

(54) WEIGHT BAR FOOT PLATE DEVICE

(71) Applicant: Daniel Potvin, Venice, FL (US)

(72) Inventor: Daniel Potvin, Venice, FL (US)

( * ) Notice: Subject to any disclaimer, the term of this patent is extended or adjusted under 35 U.S.C. 154(b) by 5 days.

(21) Appl. No.: 16/507,510

(22) Filed: Jul. 10, 2019

(65) Prior Publication Data

US 2021/0008405 A1 Jan. 14, 2021

(51) Int. Cl.

| | |
|---|---|
| ***A63B 21/00*** | (2006.01) |
| ***A63B 23/04*** | (2006.01) |
| ***A63B 23/035*** | (2006.01) |
| ***A63B 21/06*** | (2006.01) |
| ***A63B 22/00*** | (2006.01) |
| *A63B 22/04* | (2006.01) |

(52) U.S. Cl.

CPC ..... *A63B 21/4034* (2015.10); *A63B 21/06* (2013.01); *A63B 22/0056* (2013.01); *A63B 23/03525* (2013.01); *A63B 23/0405* (2013.01); *A63B 21/4033* (2015.10); *A63B 22/001* (2013.01); *A63B 22/0005* (2015.10); *A63B 22/04* (2013.01); *A63B 2022/0043* (2013.01); *A63B 2022/0053* (2013.01)

(58) Field of Classification Search

CPC . A63B 21/06; A63B 21/4034; A63B 21/4011; A63B 21/4013; A63B 21/4015; A63B 21/4033; A63B 23/03525; A63B 23/0405; A63B 23/0233; A63B 1/00; A63B 1/005; A63B 2022/0033; A63B 2023/0411

See application file for complete search history.

(56) References Cited

U.S. PATENT DOCUMENTS

| | | | | |
|---|---|---|---|---|
| 3,235,255 | A | 2/1966 | Leflar | |
| 3,850,431 | A | 11/1974 | Winans | |
| 4,257,590 | A | 3/1981 | Sullivan | |
| 4,527,797 | A | 7/1985 | Slade, Jr. | |
| 4,564,194 | A | 1/1986 | Dawson | |
| 4,598,908 | A | 7/1986 | Morgan | |
| 4,600,189 | A | 7/1986 | Olschansky | |
| 5,131,897 | A | 7/1992 | Krieger | |
| 5,397,287 | A | 3/1995 | Lindfors | |
| 5,738,617 | A | 4/1998 | Watson | |
| 5,827,154 | A * | 10/1998 | Gill | A63B 21/153 482/9 |
| 5,941,803 | A * | 8/1999 | Chamberlain | A63B 21/4045 482/51 |
| 7,004,891 | B2 * | 2/2006 | Morris | A63B 23/0405 482/101 |
| 7,074,164 | B2 * | 7/2006 | Moring, Jr. | A63B 21/0085 482/104 |
| D650,022 | S | 12/2011 | Lundquist | |
| D676,092 | S | 2/2013 | Bledson | |
| D804,594 | S * | 12/2017 | Jones | D21/694 |
| 10,406,395 | B2 * | 9/2019 | Haas | A63B 21/4013 |
| 2006/0252615 | A1 | 11/2006 | Melcer | |

* cited by examiner

*Primary Examiner* — Megan Anderson

(57) ABSTRACT

A weight bar foot plate device for safely performing leg presses includes a plate and a set of couplers. The couplers, which are coupled to a top of the plate, are configured to couple the plate to a weight bar of a leg press machine so that a bottom of the plate is positioned below the weight bar. The bottom of the plate is configured to position feet of a user who is supinely positioned below the plate, positioning the user to perform a leg press exercise.

10 Claims, 2 Drawing Sheets

WEIGHT BAR FOOT PLATE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relate to foot plate devices and more particularly pertain to a new foot plate device for safely performing leg presses.

BRIEF SUMMARY OF THE INVENTION

An embodiment of the disclosure meets the needs presented above by generally comprising a plate and a set of couplers. The couplers, which are coupled to a top of the plate, are configured to couple the plate to a weight bar of a leg press machine so that a bottom of the plate is positioned below the weight bar. The bottom of the plate is configured to position feet of a user who is supinely positioned below the plate, positioning the user to perform a leg press exercise.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
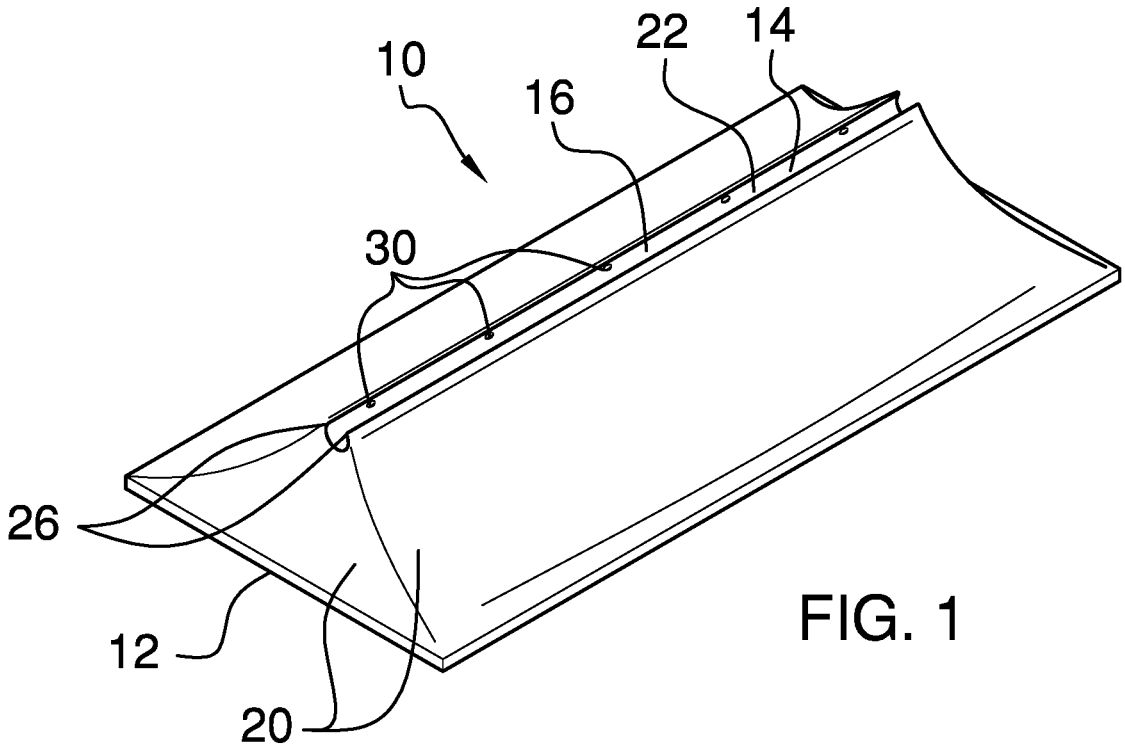
FIG. 1 is an isometric perspective view of a weight bar foot plate device according to an embodiment of the disclosure.
Figure 2:
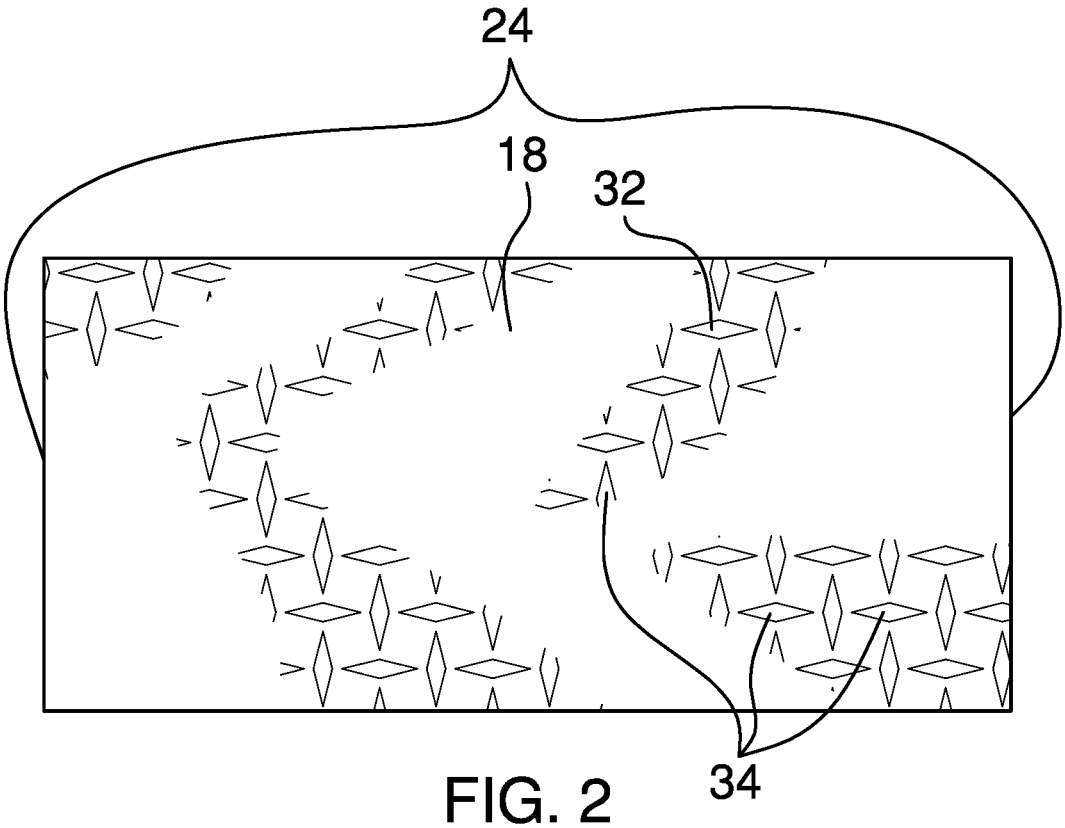
FIG. 2 is a bottom view of an embodiment of the disclosure.

With reference now to the drawings, and in particular to FIGS. 1 through 4 thereof, a new foot plate device embodying the principles and concepts of an embodiment of the disclosure and generally designated by the reference numeral 10 will be described.

Figure 3:
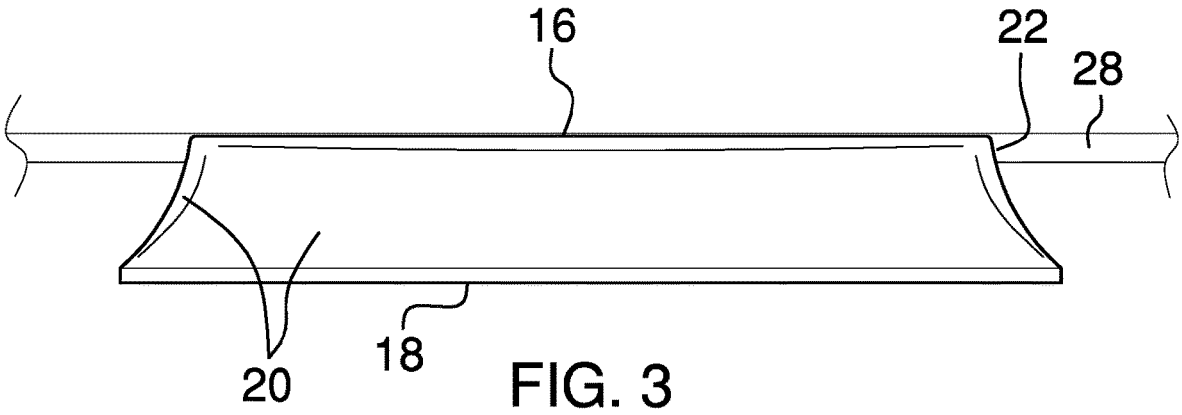
FIG. 3 is a side view of an embodiment of the disclosure.
Figure 4:
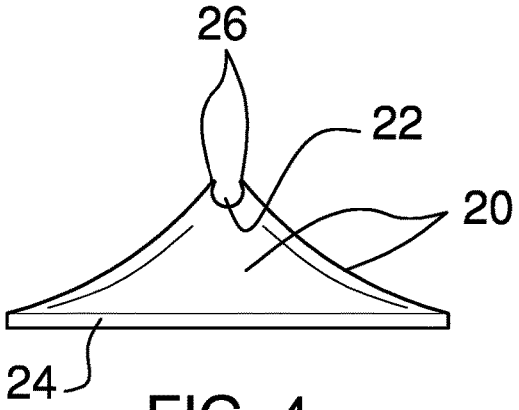
FIG. 4 is an end view of an embodiment of the disclosure.

As best illustrated in FIGS. 1 through 4, the weight bar foot plate device 10 generally comprises a plate 12 and a set of couplers 14. The plate 12 has a top 16 and a bottom 18. The top 16 is circumferentially smaller than the bottom 18 so that the plate 12 is substantially rectangular frustrum shaped. As will become apparent, the plate 12 being frustrum shaped renders the plate 12 bottom-heavy and aids in returning the plate 12 to a default position when not in use. The plate 12 comprises plastic, or the like, so that the plate 12 is substantially rigid. A sidewall 20 of the plate 12 is concavely arcuate, as shown in FIGS. 3 and 4.

The couplers 14, which are coupled to the top 16 of the plate 12, are configured to couple the plate 12 to a weight bar 28 of a leg press machine so that the bottom 18 of the plate 12 is positioned below the weight bar 28. The bottom 18 of the plate 12 is configured to position feet of a user who is supinely positioned below the plate 12, positioning the user to perform a leg press exercise. Current methods of performing leg press exercises require users to position their feet on the weight bar 28, which has the potential to cause injury to the feet due to the concentrated force applied by the weight bar 28 to the contact points with the feet. The plate 12 serves to distribute this force over all points of the feet that are in contact with the plate 12, either directly or via the soles of shoes that are positioned on the feet.

The set of couplers 14 comprises a channel 22 that extends between opposing ends 24 of the plate 12, as shown in FIG. 1, or other coupling means, such as, but not limited to, pipe straps, clamps, and the like. The channel 22 extends arcuately into the top 16 of the plate 12 to define a pair of rims 26, as shown in FIG. 4. The pair of rims 26, which comprises plastic or the like, is resiliently deformable. The rims 26 are separated by less than a diameter of the weight bar 28 so that the pair of rims 26 is configured to separate as the weight bar 28 is forced into the channel 22 and to rebound to rotationally couple the plate 12 to the weight bar 28. The plate 12 is configured to partially rotate relative to the weight bar 28 to maintain the feet of the user flush to the plate 12 during the leg press exercise. Being bottom-heavy, the plate 12 is configured to resume the default position upon removal of the feet of the user, wherein the bottom 18 is substantially horizontally positioned.

Each of a plurality of protuberances 30, which comprise plastic, or the like, and are resiliently compressible, is coupled to the plate 12 and extends into the channel 22. The protuberance 30 is configured to be compressed as the weight bar 28 is forced into the channel 22 so that the plurality of protuberances 30 frictionally couples the weight bar 28 to the plate 12.

A grip 32 that is coupled to the bottom 18 of the plate 12 is configured to deter slippage of the feet of the user during the leg press exercise. The grip 32 may comprise a plurality of protrusions 34, or other gripping means, such as, but not limited to, textured tape, textured paint, and the like. Each protrusion 34 is coupled to and extends from the bottom 18 so that the bottom 18 is diamond plate 12 textured.

In use, the plate 12 is coupled to the weight bar 28 of the leg press machine by forcing the weight bar 28 into the channel 22. The user then lies beneath the plate 12, either on a floor or a bench, and positions his or her feet on the bottom 18 of the plate 12. The user thus is positioned to safely perform the leg press exercise.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A weight bar foot plate device comprising:

a plate; and a set of couplers coupled to a top of the plate wherein the set of couplers is configured for coupling the plate to a weight bar of a leg press machine such that a bottom of the plate is positioned below the weight bar and is configured for positioning feet of a user supinely positioned below the plate such that the user is capable of performing a leg press exercise, the top being circumferentially smaller than the bottom such that the plate is rectangular frustrum shaped.

2. The weight bar foot plate device of claim 1, further including a grip coupled to the bottom of the plate wherein the grip is configured for deterring slippage of the feet of the user during the leg press exercise.

3. The weight bar foot plate device of claim 2, further including the grip comprising a plurality of protrusions, each protrusion of the plurality of protrusions being coupled to and extending from the bottom such that the bottom is diamond plate textured.

4. The weight bar foot plate device of claim 1, further including a sidewall of the plate being concavely arcuate.

5. The weight bar foot plate device of claim 1, further including the plate comprising plastic such that the plate is rigid.

6. A weight bar foot late device comprising:

a plate; and a set of couplers coupled to a top of the plate wherein the set of couplers is configured for coupling the plate to a weight bar of a leg press machine such that a bottom of the plate is positioned below the weight bar and is configured for positioning feet of a user supinely positioned below the plate positioning the user for performing a leg press exercise, the set of couplers comprising a channel extending between opposing ends of the plate, the channel extending arcuately into the top of the plate defining a pair of rims, the pair of rims being resiliently deformable, the pair of rims being separated by less than a diameter of the weight bar such that the pair of rims is configured for separating as the weight bar is forced into the channel and for rebounding for rotationally coupling the plate to the weight bar wherein the plate is configured for partial rotation relative to the weight bar for maintaining the feet of the user flush to the plate during the leg press exercise and wherein the plate is configured for resuming a default position upon removal of the feet of the user wherein the bottom is horizontally positioned.

7. The weight bar foot plate device of claim 6, further including a plurality of protuberances, each protuberance of the plurality of protuberances being resiliently compressible, each protuberance of the plurality of protuberances being coupled to the plate and extending into the channel wherein each protuberance of the plurality of protuberances is configured for compressing as the weight bar is forced into the channel such that the plurality of protuberances frictionally couples the weight bar to the plate.

8. The weight bar foot plate device of claim 7, further including the plurality of protuberances comprising plastic.

9. The weight bar foot plate device of claim 6, further including the pair of rims comprising plastic.

10. A weight bar foot plate device comprising:

a plate, the plate having a top and a bottom, the top being circumferentially smaller than the bottom such that the plate is rectangular frustrum shaped, the plate comprising plastic such that the plate is rigid, a sidewall of the plate being concavely arcuate;

a set of couplers coupled to the top of the plate wherein the set of couplers is configured for coupling the plate to a weight bar of a leg press machine such that the bottom of the plate is positioned below the weight bar and is configured for positioning feet of a user supinely positioned below the plate such that the user is capable of performing a leg press exercise, the set of couplers comprising a channel extending between opposing ends of the plate, the channel extending arcuately into the top of the plate defining a pair of rims, the pair of rims being resiliently deformable, the pair of rims being separated by less than a diameter of the weight bar such that the pair of rims is configured for separating as the weight bar is forced into the channel and for rebounding for rotationally coupling the plate to the weight bar wherein the plate is configured for partial rotation relative to the weight bar for maintaining the feet of the user flush to the plate during the leg press exercise and wherein the plate is configured for resuming a default position upon removal of the feet of the user wherein the bottom is horizontally positioned, the pair of rims comprising plastic;

a plurality of protuberances, each protuberance of the plurality of protuberances being resiliently compressible, each protuberance of the plurality of protuberances being coupled to the plate and extending into the channel wherein each protuberance of the plurality of protuberances is configured for compressing as the weight bar is forced into the channel such that the plurality of protuberances frictionally couples the weight bar to the plate, the plurality of protuberances comprising plastic; and a grip coupled to the bottom of the plate wherein the grip is configured for deterring slippage of the feet of the user during the leg press exercise, the grip comprising a plurality of protrusions, each protrusion of the plurality of protrusions being coupled to and extending from the bottom such that the bottom is diamond plate textured.

* * * * *